United States Patent [19]

Le Lande, Jr.

[11] Patent Number: 4,836,290

[45] Date of Patent: Jun. 6, 1989

[54] FIRE SUPPRESSION SYSTEM

[76] Inventor: Walter C. Le Lande, Jr., 301 N. Hart Pl., Fullerton, Calif. 92631

[21] Appl. No.: 908,808

[22] Filed: Sep. 17, 1986

[51] Int. Cl.[4] ..... A62C 1/20

[52] U.S. Cl. ..... 169/46; 169/61; 169/11; 169/13; 169/54

[58] Field of Search ..... 169/43–48, 169/54, 56, 60, 61, 5, 13, 14, 15, 16, 11

[56] References Cited

U.S. PATENT DOCUMENTS

| | | | |
|---|---|---|---|
| 1,806,829 | 5/1931 | Siebenmann . | |
| 2,961,049 | 11/1960 | Toulmin . | |
| 3,179,181 | 4/1965 | Banzato | 169/13 |
| 3,562,156 | 2/1971 | Francen . | |
| 3,583,490 | 6/1971 | McFadden | 169/60 |
| 3,588,893 | 6/1971 | McCloskey . | |
| 3,772,195 | 11/1973 | Francen . | |
| 3,862,718 | 1/1975 | Butler | 169/61 X |
| 3,957,658 | 5/1976 | Chiesa et al. . | |
| 4,079,786 | 3/1978 | Moling . | |
| 4,091,874 | 5/1978 | Monma . | |
| 4,227,577 | 10/1980 | Iida . | |
| 4,272,414 | 6/1981 | Vandersall . | |
| 4,330,040 | 5/1982 | Ence et al. | 169/16 X |
| 4,428,434 | 1/1984 | Gelaude | 169/13 |

FOREIGN PATENT DOCUMENTS

| | | | |
|---|---|---|---|
| 671819 | 7/1979 | U.S.S.R. | 169/61 |
| 1215724 | 3/1986 | U.S.S.R. | 169/11 |

*Primary Examiner*—Sherman D. Basinger
*Assistant Examiner*—Paul E. Salmon
*Attorney, Agent, or Firm*—Fay, Sharpe, Beall Fagan, Minnich & McKee

[57] ABSTRACT

A fire extinguishing system for roof fires or the like includes a fire sensor for monitoring a condition indicative of a fire and for signaling the sensing of the condition. A first fire extinguishing member is provided for spraying a fire retardant fluid onto an exterior surface of an associated roof. A logic circuit is connected to the fire sensor and the first fire extinguishing member for actuating the first fire extinguishing member as driven by the fire sensor.

9 Claims, 2 Drawing Sheets

3B
3B

FIRE SUPPRESSION SYSTEM

BACKGROUND OF THE INVENTION

This invention generally pertains to fire suppression systems. More specifically, the present invention relates to a fire suppression system for a building roof.

The invention is particularly applicable to fire suppression systems for wood shake, or shingle roofs. However, it will be appreciated by those skilled in the art, that the invention has broader application and may also be adapted for use in many other fire suppression environments.

Wood shakes and shingles are frequently used as roofing materials due to their attractive appearance. Usually such shakes or shingles are made of untreated cedar which dries out and, becomes extremely flammable a few years after installation. Even when such shakes are treated with a fire suppressant chemical before installation, the shakes still dry out in a few years and become quite flammable. Such roofs in the drier southwestern and western areas of the United States are frequently dangerous fire hazards.

Wood shake roofs used on multi-unit residential dwellings in the dry regions of the sunbelt, such as in southern California, where numerous brush fires burn every year, are particularly dangerous. For example, in April, 1982 a 364 unit apartment complex in Anaheim, Ca. was destroyed by fire after a spark generated from lightning that struck a major electrical transformer started the cedar shake roofs of the apartment complex on fire. The complex had burned to the ground by the time the fire department arrived. Another fire related disaster occured in Dallas in March of 1983. A large apartment complex having over 850 units was partially destroyed by fire when a faulty wiring system shorted out in the ceiling joists of one of the buildings and the sparks ignited the wood shingled roof. The flames spread quickly to all the roofs of the apartment complex and by the time the fire department arrived, 200 units of the complex had burned to the ground. There were also numerous injuries to firefighters and tenants, luckily, none were life threatening.

While several fire suppression systems are known for buildings and some chemical fire retardant treatment processes are known for wood shake roofs, none of these has been found to be entirely satisfactory in preventing the ignition and burning of wood shake or shingle roofs.

Accordingly, it has been considered desirable to develop a new and improved fire suppression system for wood shake and shingle roofs which would overcome the foregoing difficulties and others while providing better and more advantageous overall results.

BRIEF SUMMARY OF THE INVENTION

In accordance with the invention, a new and improved fire suppression system is provided for roof fires or the like.

More particularly in accordance with this aspect of the invention, a fire sensor means is provided for monitoring a condition indicative of a fire and for signaling a sensing of the condition. A first fire extinguishing means is provided for spraying a fire retardant fluid onto an exterior surface of an associated roof. A logic cicuit is connected to the fire sensor means and the first fire extinguishing means for actuating the first fire extinguishing means as driven by the fire sensor means.

In accordance with another aspect of the invention, the system further comprises a manually operatable control means for overriding the logic circuit and activating the first fire extinguishing means.

According to another aspect of the invention, the system further comprises a second fire extinguishing means for injecting a fire retardant gas in an associated attic located under the associated roof.

In accordance with still another aspect of the invention, the system further comprises at least one ventillation fan for selectively circulating air through the associated attic under the associated roof when no fire condition is sensed. Preferably, a closure means is provided for closing an air intake of the at least one ventillation fan with the closure means being activated by the logic cicuit. In the preferred embodiment, two spaced ventillation fans are provided to allow better circulation of air through the associated attic.

In accordance with yet another aspect of the invention, the first fire extinguishing means comprising a spray nozzle, a fluid ciruit, a fire retardant fluid holding tank, and valve means for controlling the flow of a fire retardant fluid from the holding tank through the fluid circuit to the spray nozzle. Preferably, the first fire extinguishing means further comprises a source of water and a water conduit connecting the source of water to the fluid circuit. A mixing means, which is located in the fluid circuit, is also provided for mixing the water from the source of water with the fire retardant fluid before the mixture exits through the spray nozzle. The source of water can be provided by a conventional water supply or an emergency water supply.

In accordance with yet another aspect of the invention, the system further comprises an emergency power supply for powering the logic circuit even during power outages.

According to another aspect of the invention, a method is provided for extinguishing a fire on a wood shingle or shake roof.

More particularly in accordance with this aspect of the invention, the method comprises the step of sensing a fire condition and actuating a closure means for sealing an attic beneath the wood shingle roof against the inflow of air. A fire retardant mixture is then sprayed onto the exterior surface of the wood shingle roof to extinguish or suppress a roof fire.

In accordance with another aspect of the invention, the method comprises the further step of injecting a fire retardant gas into the attic.

One advantage of the present invention is the provision of an effective and fast acting fire suppression system for wood shingle or shake roofs to retard the combustion thereof.

Another advantage of the present invention is its provision of a fire sensor for monitoring a condition indicative of a fire and a logic circuit connected to the fire sensor and to a liquid fire extinguisher system for actuating the fire extinguisher system as driven by the fire sensor.

Yet another advantage of the invention is the provision of a fire extinguishing system that provides for the spraying of a fire retardant fluid onto an exterior surface of the wood shingle or shake roof to retard the combustion thereof.

Still another advantage of the present invention is its provision of a manually operable control means for overriding the logic circuit and activating the first fire extinguisher.

A further advantage of the present invention is the provision of a second fire extinguishing means for injecting a fire retardant gas into the attic under the roof to retard combustion.

Yet still another advantage of the present invention is the provision of a sealed attic in which at least one, and preferably two, ventillation fans are provided for selectively circulating air through the attic when no fire condition is sensed. An air intake of the ventillation fan is closed by a closure means when a fire condition is sensed. The closure means is activated by the logic circuit.

An additional advantage of the present invention is the provision of a fire extinguishing means which comprises a fire retardant fluid provided in a holding tank, a fluid ciruit preferably containing water, a mixing device for mixing the fire retardent fluid with water, and a spray nozzle through which the mixture of retardant fluid and water can be ejected to onto the roof.

A still further advavntage of the present invention is the provision of an emergency power supply for powering the logic circuit even during power outages.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts a preferred embodiment of which will be described in detail in this specification and illustrated in the accompanying drawings which form a part hereof and wherein.

DETAILED DESCRIPTION OF THE PREFERRED EMBODIMENTS

Figure 1:
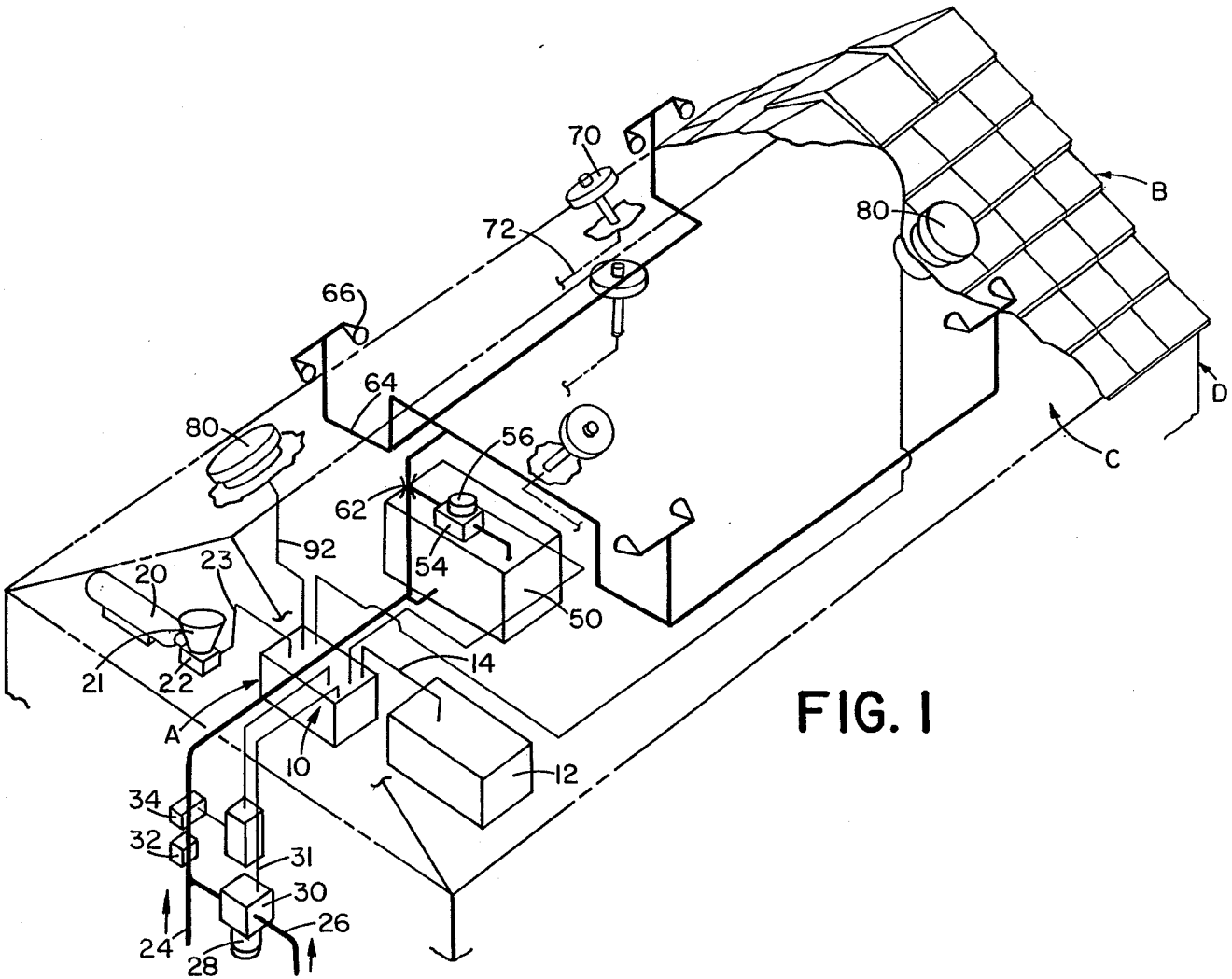
FIG. 1 is a schematic perspective view, partially broken away, of a fire suppression system and an associated roof according to the present invention.

Referring now to the drawings wherein the showings are for purposes of illustrating a preferred embodiment of the invention only and not for purposes of limiting same, FIG. 1 shows the subject new fire suppression system A in schematic form positioned on a roof B overlying an attic C of a multi-unit building D. While the fire suppression system is primarily designed for and will hereinafter be described in connection with the suppresion of fires occurring in wood roof shingles or shakes, it will be appreciated that the overall inventive concept involved could be adapted for use in other fire suppresion environments as well.

More particularly, the fire suppression system A comprises a control means 10, which can be a microcomputer or the like, and functions as the nerve center of the system. The control means 10 can be powered by the conventional electrical supply of the building D. If a fire occurs, however, such electrical supply may be interrupted. In order to provide power for the control means 10 in the event of such an emergency, a conventional auxiliary power source 12 is also provided. A wiring connection 14 leads from the auxiliary power source to the control means.

A tank 20 of fire suppressant gas, such as $CO_2$, is also provided and is positioned in the attic C of the building D. The tank includes a nozzle 21 and a valve 22 which is actuated from the control means 10 by a lead wire 23. The function of the fire suppressant gas is to forestall or suppress any fires that may spread into the attic C.

A water pipe 24 leads from the building's regular water supply to attic. In case this supply is interrupted, such as by low water pressure during a fire, an auxillary water supply pipe 26 is also provided. This pipe may provide water from an auxillary source of water such as a swimming pool of the preferably multi-dwelling building D. In order to pull the water from the auxillary water supply up to the attic, a pump 28 is provided in the auxiliary water supply circuit. A valve means 30 controlled by the control means 10 actuates the pump 28 once it is sensed that water is not flowing through the pipe 24 from the conventional water supply. A wiring lead 31 connects the valve or switch means 30 to the control means 10.

Figures 2, 3A, 3B:
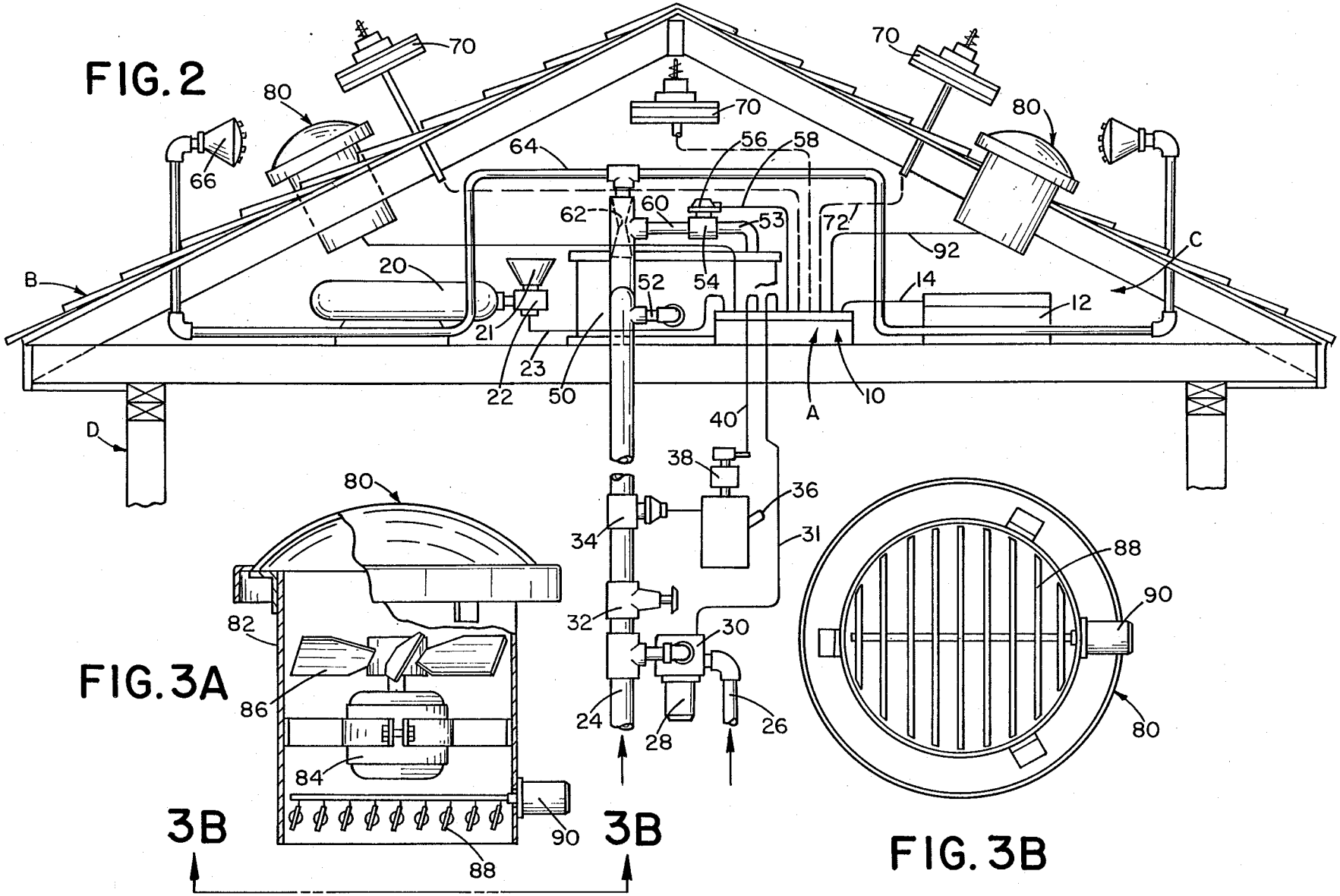
FIG. 2 is a side elevational view of the fire suppression system and roof, in partial cross section, according to FIG. 1.
FIG. 3A is an enlarged side elevational view partially in cross-section, of an attic ventillation fan according to the present invention; and, FIG. 3B is an end elevational view of the fan of FIG. 3A.

With reference now also to FIG. 2, a manual shut-off valve 32 is provided in the water line or water pipe 24 downstream of the auxiliary water supply inlet. A control valve 34 operated by the control means 10 is provided downstream of the manual shut-off valve 32. With reference now also to FIG. 2, the control valve can be manually tripped as at 36 when a fire condition is seen or anticipated so that reliance need not be had exclusively on the fire sensors which will be described below. On the other hand, the control means 10 can actuate the control valve 34 through an automatic trip means 38. A wiring lead 40 connects the control means 10 to the automatic trip means 38.

A fire suppressant liquid tank 50 is provided in the attic C and a water pipe 52 allows water to flow from the water conduit 24 into the tank to pressurize the liquid therein and cause it to flow through a pipe 53 and to a concentrator valve 54. The valve 54 is actuated by a conventional control solenoid 56 through a control wire 58 and controls the amount of fire suppressant fluid that is able to flow through a pipe 60 into a venturi eductor 62 positioned within the water pipe 24. This educator enables a mixing of the fire suppressant fluid with water before the mixture flows through piping 64 and through a plurality of conventional nozzles 66 positioned on the exterior of the roof B.

The fire suppressant fluid may be a detergent foam, a protein foam, or an aqueous film forming foam such as the LIGHT WATER brand of aqueous film forming foam sold by 3M Corporation. Aqueous film forming foams are particularly advantageous in that they are designed to be used with water and, when proportioned with water and applied with conventional foam or water/fog equipment, the chemical generates a white foam with the ability to make water float on flammable liquids which are lighter than water. The foam spreads over the the surface of the burning material forming a blanket in the manner of conventional foams. However, an aqueous solution drains from the foam bubbles and forms a vapor sealing film that floats on the surface of the burning matter and suppresses any volatile vapors, sparks, or the like. Preferably, the fluid has a low surface tension to thus provide excellent penetrating and wetting qualities which can be important in extinguishing wood shingle fires.

A plurality of conventional ultraviolet sensors 70 are provided for sensing a fire condition on the roof B. Two of these are preferably positioned on the outer surface of the roof, one of each side thereof, while a third one is preferably positioned at the apex of the attic C to sense any sparks or the like in the attic. Suitable wiring 72 leads from each of the sensor means 70 to the control means 10. Of course more or less than three such sensors 70 could be provided as circumstances require.

In order to retard the spread of fire in the attic C, the attic is preferably sealed by closing all outside air sources such as by blocking all the air vents. This diminishes air movement in the attic. However, since stagnant air in the attic would, in the summertime, get quite hot, a pair of ventillation fans 80 are provided for the roof B to establish an air circulation pattern in the attic C.

With reference now to FIG. 3A, each of these fan assemblies 80 includes a housing 82, a motor 84, several fan blades 86, as well as louvers of shutters 88, and a control solenoid 90. Suitable wiring 92 leads from the control means 10 to the solenoid. A suitable conventional thermostat (not illustrated) can be provided in the attic to actuate each fan's motor 84 when the temperature in the attic climbs past a selected temperature. It should be noted that the sensor means 70 can be suitably configured to also function as the thermostat for the regulation of the fan assemblies 80 when no fire condition is sensed. When, however, the sensor means 70 senses a fire condition, the solenoid 90 is acutated through the control means 10 to close the shutters 88 (see FIG. 3B) and thereby prevent any further air circulation into or out of the attic through the fan assemblies 80.

In use, when a fire condition is sensed by the sensor means 70, or when the manual trip 36 is acitvated, power to the motors 84 of the fan assemblies 80 is shutoff and the shutters 88 are closed thereby preventing any further air circulation in the attic C. The control means 10 then actuates the valve 22 of the fire suppressant gas to allow gas to flow out of tank 20 through nozzle 21 and fill the attic with a fire retardant or suppressant gas, such as $CO_2$.

Simultaneously, the automatic trip 38 is actuated by the control means 10 (unless already previously actuated by manual trip 36) to open control valve 34 and allow water to flow through the water pipe 24. Fire suppressant fluid from tank 50 is urged to flow into and be mixed with the water in the venturi educator 62 from which the water and fire suppressant fluid combination flows through piping 64 and nozzles 66 onto the shingles on the exterior of the roof B. If the shingles are already buring, then the water-fire suppressant fluid mixture will tend to put the flame out. If the shingles are not yet ignited, then the mixture will tend to prevent such ignition from taking place. Thus the potential roof fire is either prevented from occuring at all or is extinguished very quickly thereby saving the roof of the building and hence the units therewithin.

It should be noted that if the manual trip 36 is activated, the control means will sense this and actuate the valve 22 of the fire suppressant gas in the attic just as with the automatic operation thereof.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

What is claimed is:

1. A fire extinguishing system for roof fires or the like, comprising:

a fire sensor means for monitoring a condition indicative of a fire and for signaling the sensing of the condition;

a first fire extinguishing means for spraying a fire retardant fluid onto an exterior surface of an associated roof, said first fire extinguishing means comprising:

a fluid circuit, a spray nozzle in communication with said fluid circuit, a source of water, a water conduit connecting said source of water to said fluid circuit, a fire retardant fluid holding tank in communication with said fluid circuit, said tank holding a fluid other than water and a venturi eductor located in said fluid ciruit for mixing water from said water conduit with said fire retardant fluid before said mixture exits through said spray nozzle; and, a logic circuit control means connected to said fire sensor means and said first fire extinguishing means for actuating said first fire extinguishing means as driven by said fire sensor means.

2. The system of claim 1 further comprising a manually operable control means for overriding said logic circuit and activating said first fire extinguishing means.

3. The system of claim 1 further comprising a second fire extinguishing means comprising:

a fire retardant gas storage container;

a valve means for controlling the venting of fire retardant gas from said container into an associated attic located under said associated roof; and, a control wire connecting said valve means to said logic circuit control means.

4. The system of claim 1 further comprising at least one ventillation fan for selectively circulating air through an associated attic located under the associated roof when no fire condition is sensed in order to cool the associated attic.

5. The system of claim 4 further comprising a closure means for closing an air intake of said at least one ventillation fan, when a fire condition is sensed.

6. The system of claim 4 wherein two spaced ventillation fans are provided to allow better circulation of air through the associated attic.

7. The system of claim 1 wherein said first fire extinguishing means further comprises the fire retardant fluid from said holding tank through said fluid circuit to said spray nozzle.

8. The system of claim 1 wherein said source of water is an emergency water supply.

9. The system of claim 1 further comprising an emergency power supply for powering said logic circuit control means even during power outages.

* * * * *